US006382743B1

(12) United States Patent
Gollob

(10) Patent No.: US 6,382,743 B1
(45) Date of Patent: May 7, 2002

(54) DOOR-HINGING SYSTEM FOR NEWS-STANDS

(75) Inventor: Neal Christopher Gollob, Waterloo (CA)

(73) Assignee: Go-Plastics Inc., Kitchener (CA)

( * ) Notice: Subject to any disclaimer, the term of this patent is extended or adjusted under 35 U.S.C. 154(b) by 0 days.

(21) Appl. No.: 09/810,393

(22) Filed: Mar. 19, 2001

(51) Int. Cl.[7] ..... A47B 3/00
(52) U.S. Cl. ..... 312/102; 49/390; 312/328
(58) Field of Search ..... 312/101, 102, 312/100, 42, 328; 211/50; 49/388, 390; 232/1 C

(56) References Cited

U.S. PATENT DOCUMENTS

| | | | | | |
|---|---|---|---|---|---|
| 4,067,477 | A | * | 1/1978 | Chalabian | 221/1 |
| 4,651,896 | A | | 3/1987 | Harrell | 221/229 |
| 4,700,869 | A | | 10/1987 | Bogner | 221/229 |
| 4,756,448 | A | | 7/1988 | Dahl | 221/4 |
| 4,765,469 | A | | 8/1988 | Seifert | 206/309 |
| 4,875,598 | A | | 10/1989 | Dahl | 221/4 |
| 5,178,299 | A | * | 1/1993 | Mundt | 221/232 |
| 5,198,991 | A | | 3/1993 | Pollitt | 364/708 |
| 5,267,127 | A | | 11/1993 | Pollitt | 361/680 |
| 5,305,913 | A | | 4/1994 | Shade | 221/226 |
| 5,383,560 | A | | 1/1995 | Gueret | 206/581 |
| 5,394,997 | A | | 3/1995 | Gollob | 221/187 |
| 5,791,508 | A | | 8/1998 | Arnould | 220/254 |
| 5,834,690 | A | | 11/1998 | Bastiaansen | 174/52.1 |
| 6,050,686 | A | | 4/2000 | De Rossi | 351/153 |
| 6,318,627 | B1 | * | 11/2001 | Koebbe | 232/1 C |

* cited by examiner

*Primary Examiner*—Peter M. Cuomo
*Assistant Examiner*—Jerry A. Anderson
(74) *Attorney, Agent, or Firm*—Anthony Asquith & Co.

(57) ABSTRACT

The news-stand body comprises a rotation-moulded plastic shell. The walls of the shell are arranged in folds, and the hinge-pin mounting holes are provided therein. The hinge pin straddles the folds, which provides for a secure and rigid mounting. The edges of the (transparent) door are bent to form flanges, and the hinge pin passes through holes in the flanges.

13 Claims, 8 Drawing Sheets

PRIOR ART 37
25a 10
37
25a
43
34
10
39
42
40
25a
38
32
25a
30

DOOR-HINGING SYSTEM FOR NEWS-STANDS

This invention relates to news-stands, being structures of the type as used for presenting newspapers and other publications to the public. The publications are contained in an enclosed protective compartment of the news-stand, having a door. In some types of news-stands, the door is locked closed and can only be opened after coins have been inserted into a coin-slot. The invention will be described as it relates to news-stands of the type in which the door may be opened freely, without the need for a person to insert money.

BACKGROUND TO THE INVENTION

The publications in the news-stand may be intended to be taken freely (such as real-estate listings, advertisements, etc), and therefore there is nothing in the news-stand to be stolen. Still, there are members of the public who derive amusement from inflicting damage to structures in public places.

It is well-known that a news-stand that comprises basically a one-piece plastic moulding, though not of course indestructible, can be robust enough to stand up to the inevitable abuse that is inflicted on structures in public places. As such, it is advantageous to form the plastic structure by rotation-moulding, and a news-stand of this general type is illustrated in our patent U.S. Pat. No. 5,394,997 (Gollob, May 1995).

THE INVENTION IN RELATION TO THE PRIOR ART

The invention relates to a door-hinging system, and is advantageously applicable when the axis of the hinge is horizontal. As such, the door may rather be termed a swinging flap, but the term door is used, particularly since the invention is not limited to the axis of the hinge being horizontal.

Many hinging systems have been proposed for openable flaps and doors, being systems that depend on the use of a hinge-pin about which the door can pivot. The designer of the hinging system must see to it that the relatively-pivoting components are secured in a manner that allows free and easy movement about the hinge, and yet the hinge-pin must be secured rigidly, so the pin cannot bend or distort which would interfere with smooth pivoting.

It is especially difficult to secure the hinge-pin to the pivoting components when the components are made of thin sheet material, since sheet material has little inherent rigidity (other than in the plane of the sheet). One conventional type of hinging system, which is further described below, makes use of a piano-hinge, which is secured to the thin sheet material of the body of the news-stand, and secured to the thin sheet material of the door, with rivets. The lack of stiffness of the thin material means that the piano-hinge must itself supply almost all the rigidity it needs for proper functioning, by itself, without assistance from the sheet material. Also, it is notoriously difficult to ensure that fasteners attached to sheet material remain tight.

One common engineering means for increasing stiffness and rigidity in components made of sheet material is to so form the sheet material as to create ribs and folds. The invention shows how to utilise the shape of the news-stand itself, with the addition of some folds, to provide a hinge-pin system in which the rigidity the hinge-pin needs for proper mechanical functioning arises inherently, as a result of the shape of the body-shell.

Preferably, in the invention, the hinge-pin is held in through-holes in sheet material. That being so, it is important that the hinge pin not be able to rock, at all, within the holes; if it could rock, the pin could work loose. Again, the invention shows how the thin material can be arranged such that the pin cannot rock relative to the holes. Thus, such tightness of fit as may be built into the hinge pin and the holes in which the pin is mounted can be expected to remain tight over a long service life.

DETAILED DESCRIPTION OF PREFERRED EMBODIMENTS

By way of further explanation of the invention, exemplary embodiments of the invention will now be described with reference to the accompanying drawings, in which.

Figure 5:
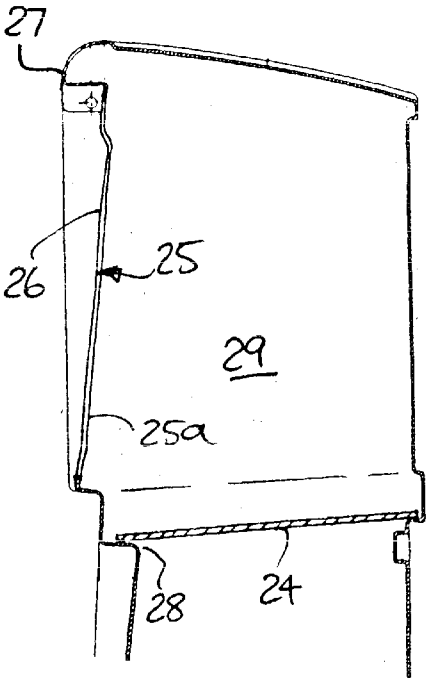
FIG. 5 is the same view as FIG. 4, except that the body component of the news-stand is finished.
Figure 6:
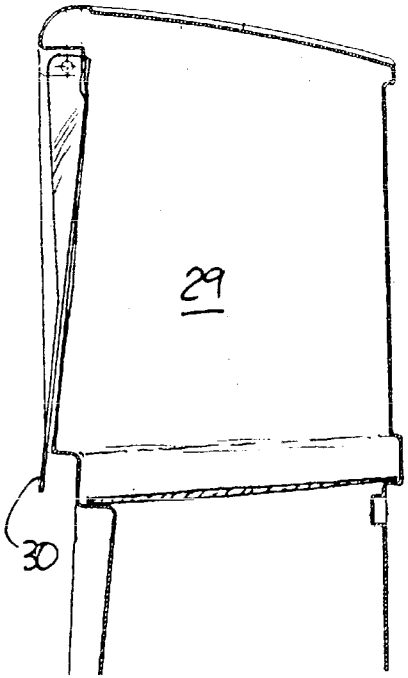

FIG. 6 the same view as FIG. 5, and shows the rest of the components of the news-stand.

Figures 2, 3:
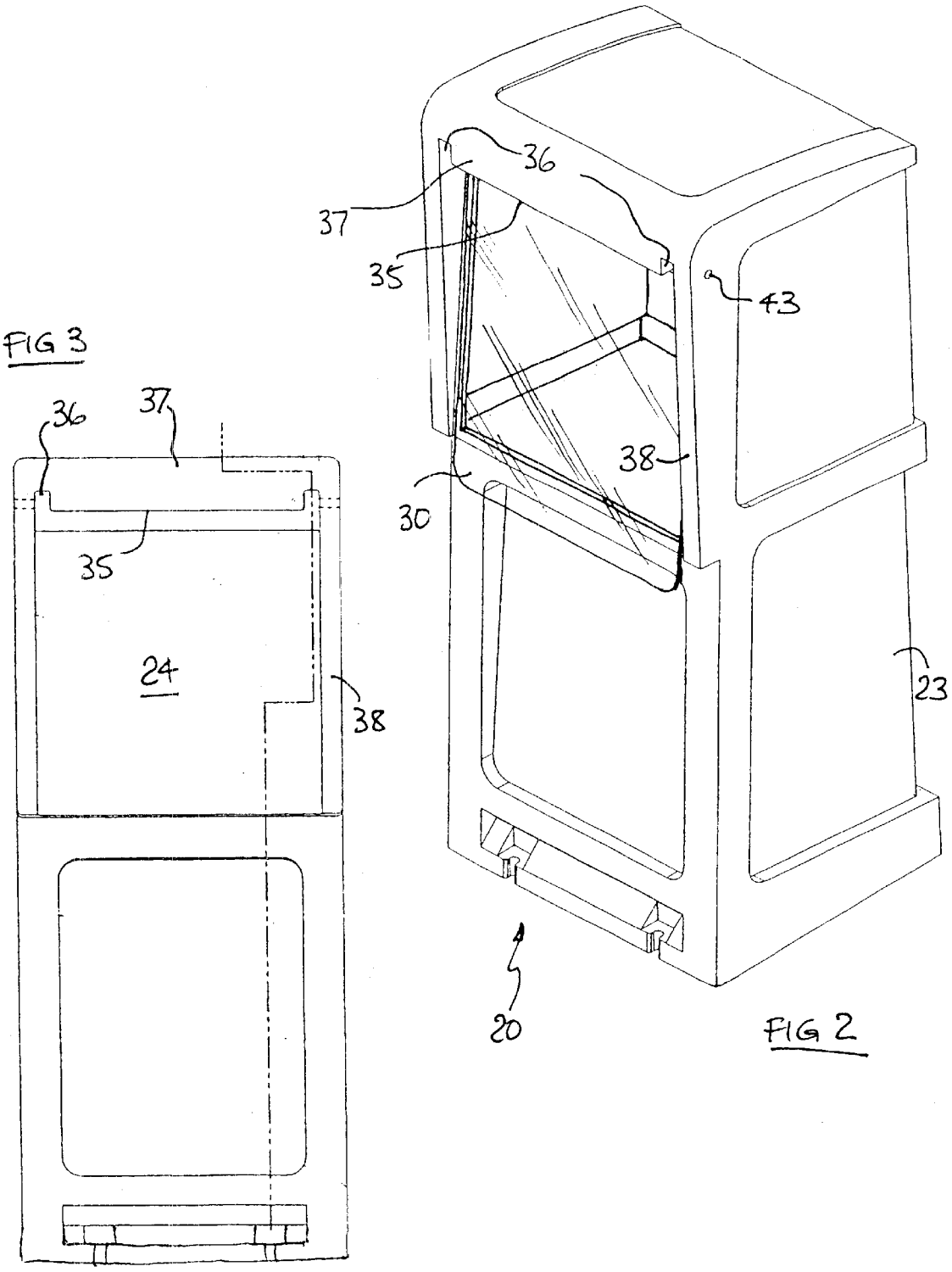
FIG. 2 is a pictorial view of a news-stand that embodies the invention.
FIG. 3 is a front view of a body-shell of the news-stand of FIG. 2, shown in an as-moulded, not yet finished, form.
Figure 7:
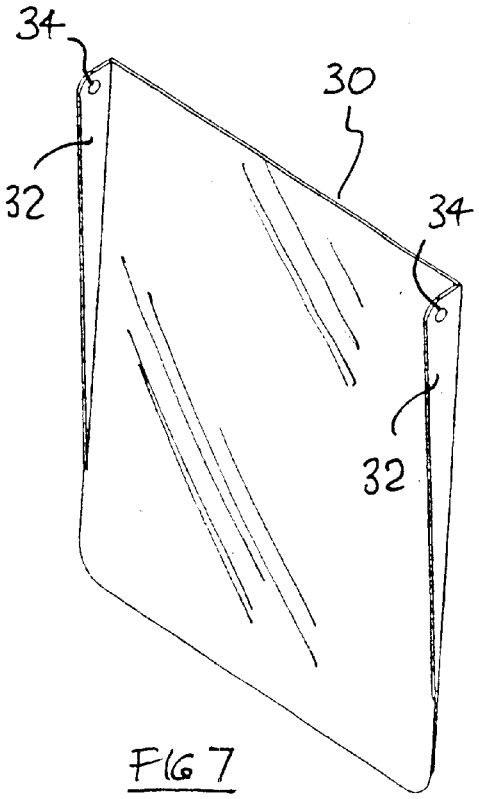

FIG. 7 is a pictorial view of a door of the news-stand of FIG. 2.

Figure 8:
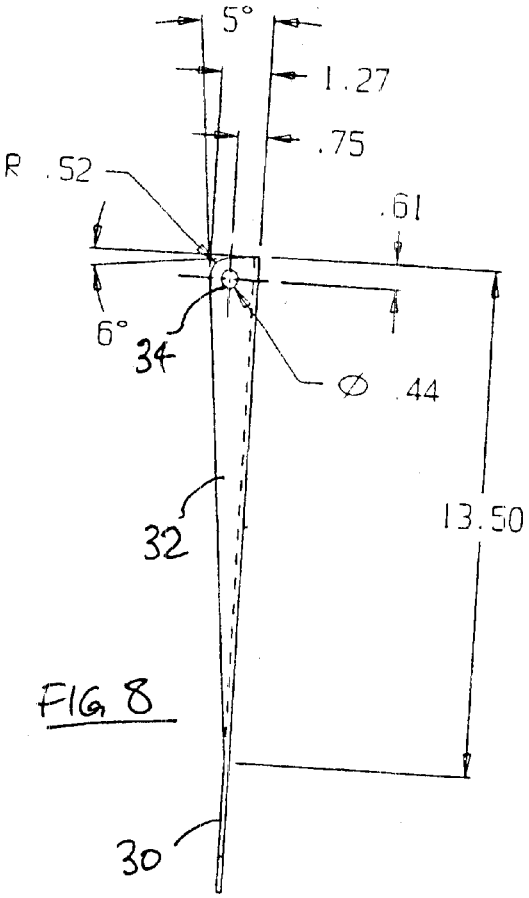

FIG. 8 is a side-view of the door of FIG. 7.

Figure 9:
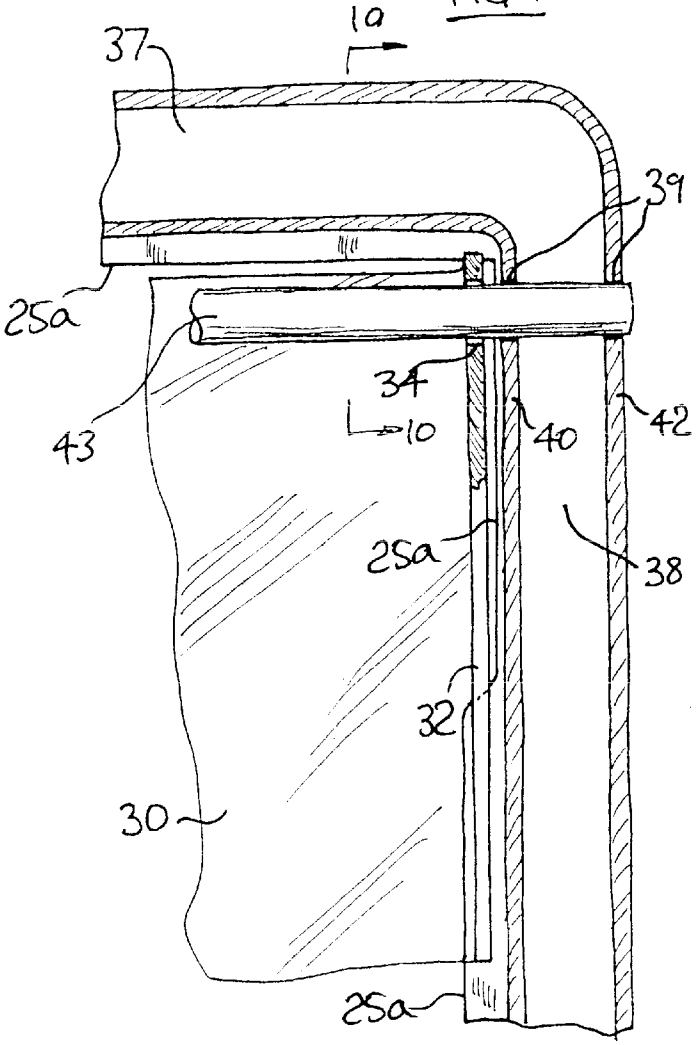

FIG. 9 is a front-view, in cross-section, of a portion of another news-stand that embodies the invention.

Figure 10:
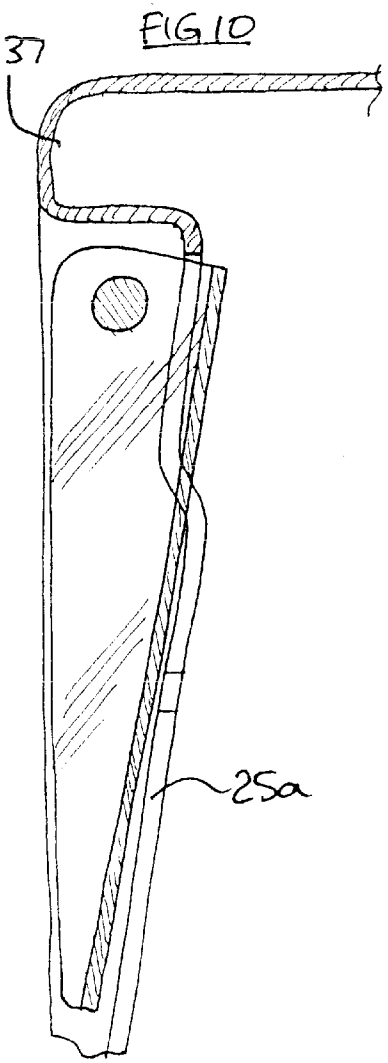

FIG. 10 is a side-view, in cross-section, of the news-stand of FIG. 9.

Figure 11:
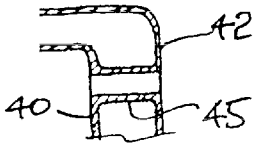

FIG. 11 is a view of a portion of the body-shell of a modified news-stand.

Figure 12:
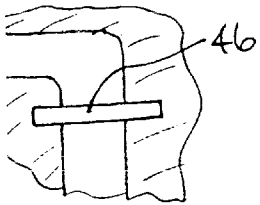

FIG. 12 is a corresponding view to FIG. 11 of a mould, in which the body-shell was rotation-moulded.

Figure 13:
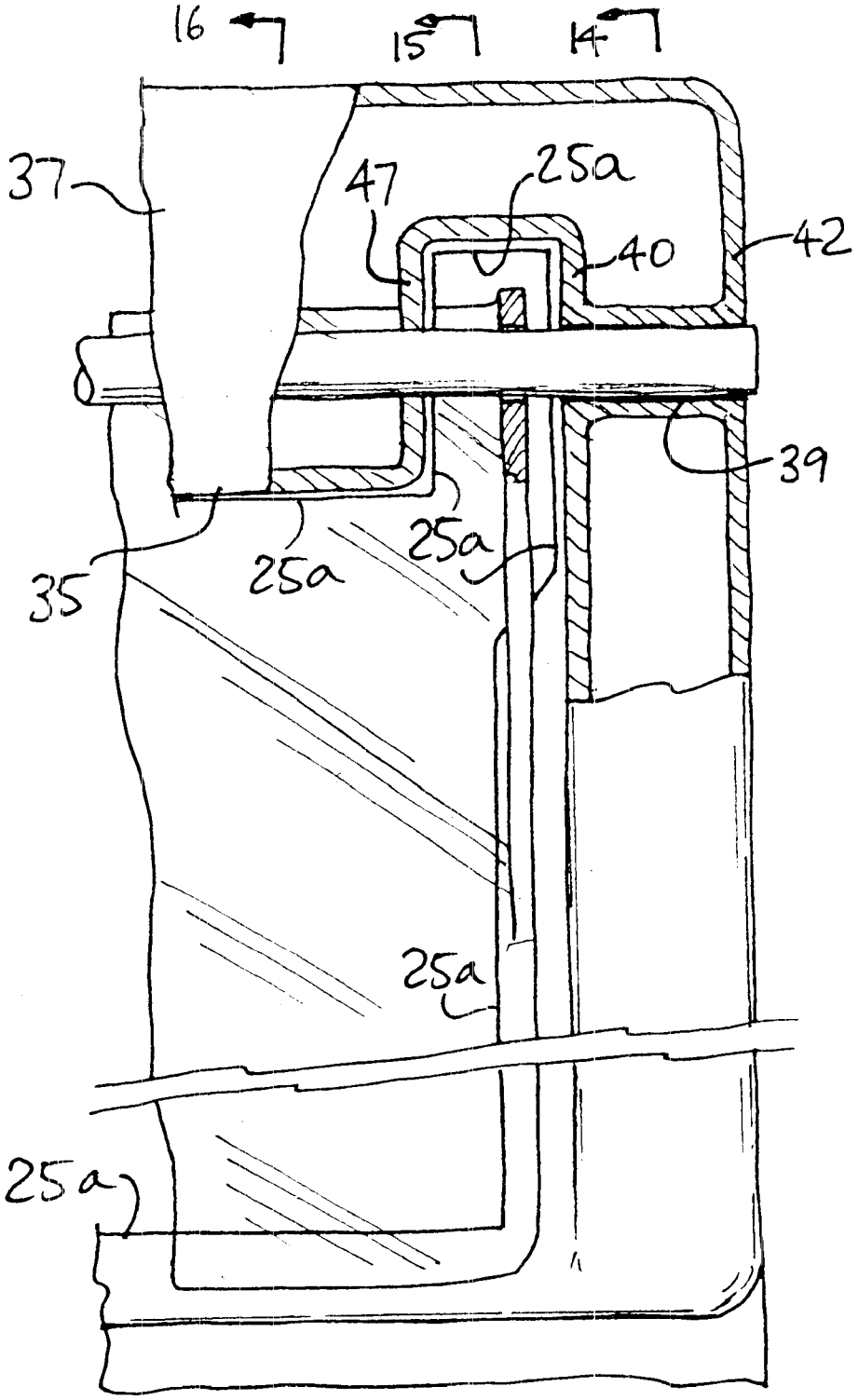

FIG. 13 is a front-view, in cross-section, of a portion of the news-stand of FIG. 2.

Figure 14:
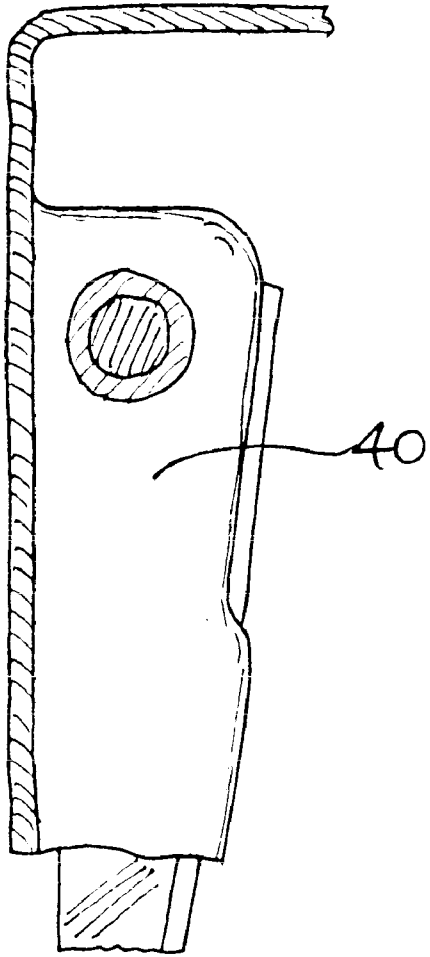

FIG. 14 is a cross-sectional view on arrow 14 of FIG. 13.

Figure 15:
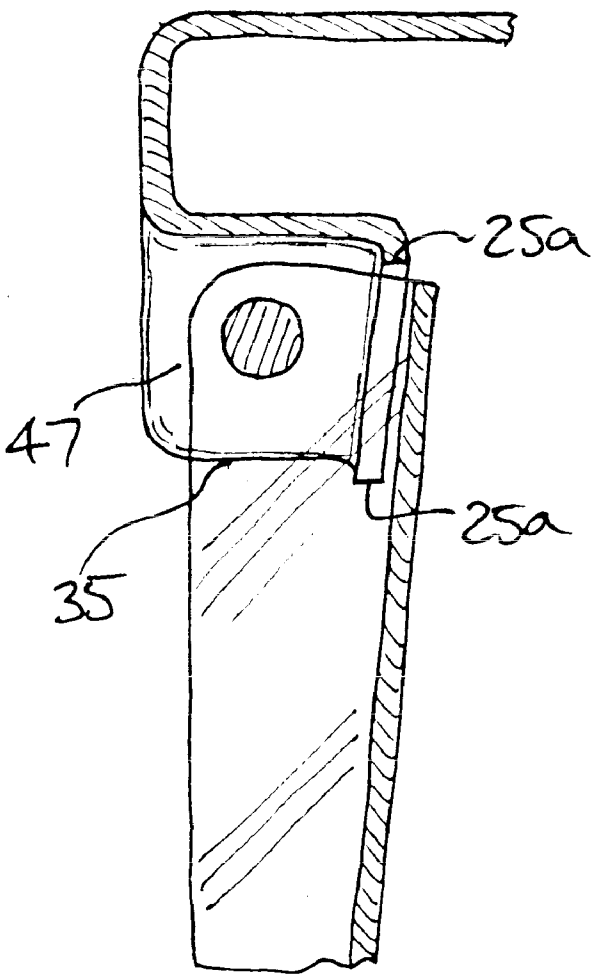

FIG. 15 is a cross-sectional view on arrow 15 of FIG. 13.

Figure 16:
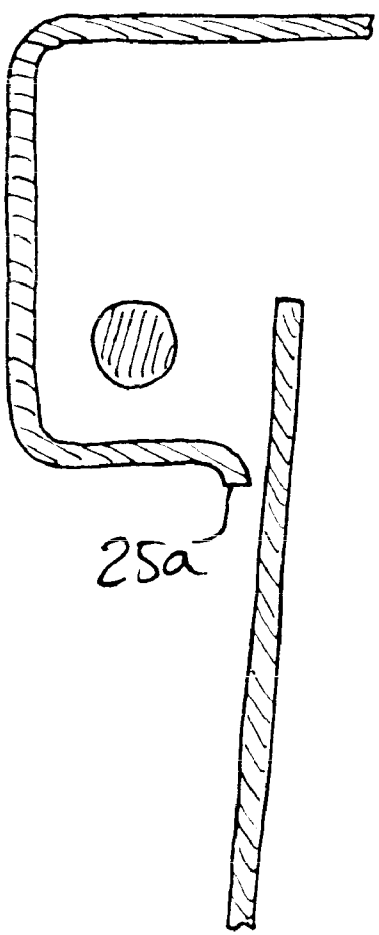

FIG. 16 is a cross-sectional view on arrow 16 of FIG. 13.

Figure 17:
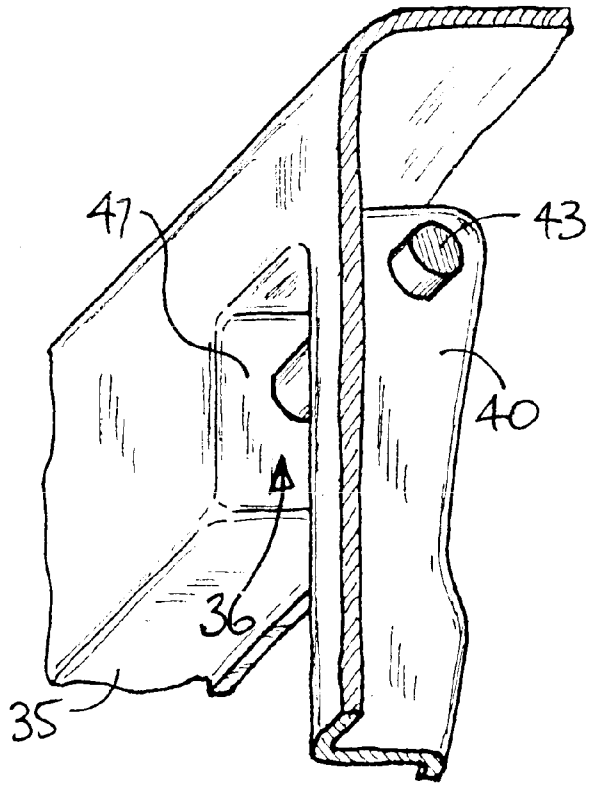

FIG. 17 is a pictorial view corresponding to the cross-section of FIG. 14, shown with the door omitted.

Figure 18:
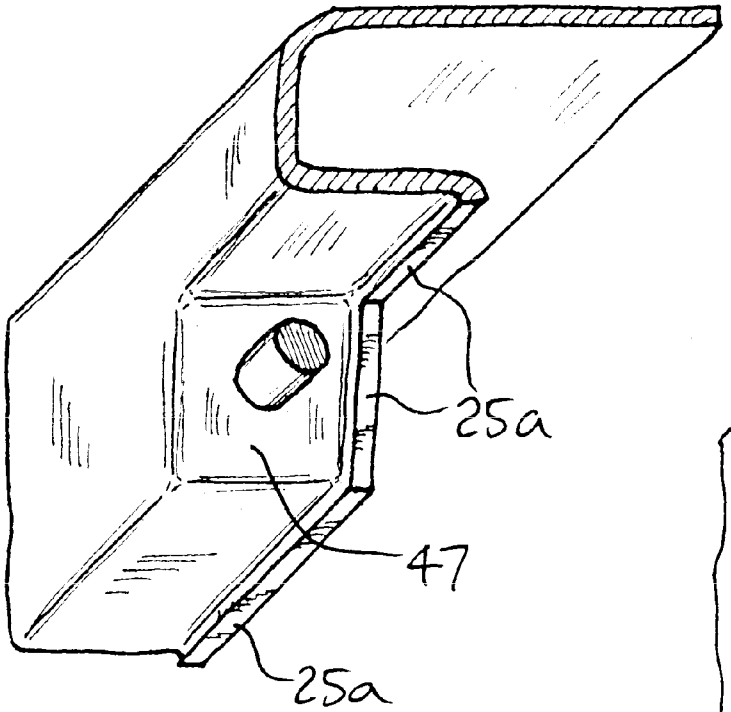

FIG. 18 is a similar pictorial view, corresponding to the cross-section of FIG. 15.

The apparatuses shown in the accompanying drawings and described below are examples which embody the invention. It should be noted that the scope of the invention is defined by the accompanying claims, and not necessarily by specific features of exemplary embodiments.

Figure 1:
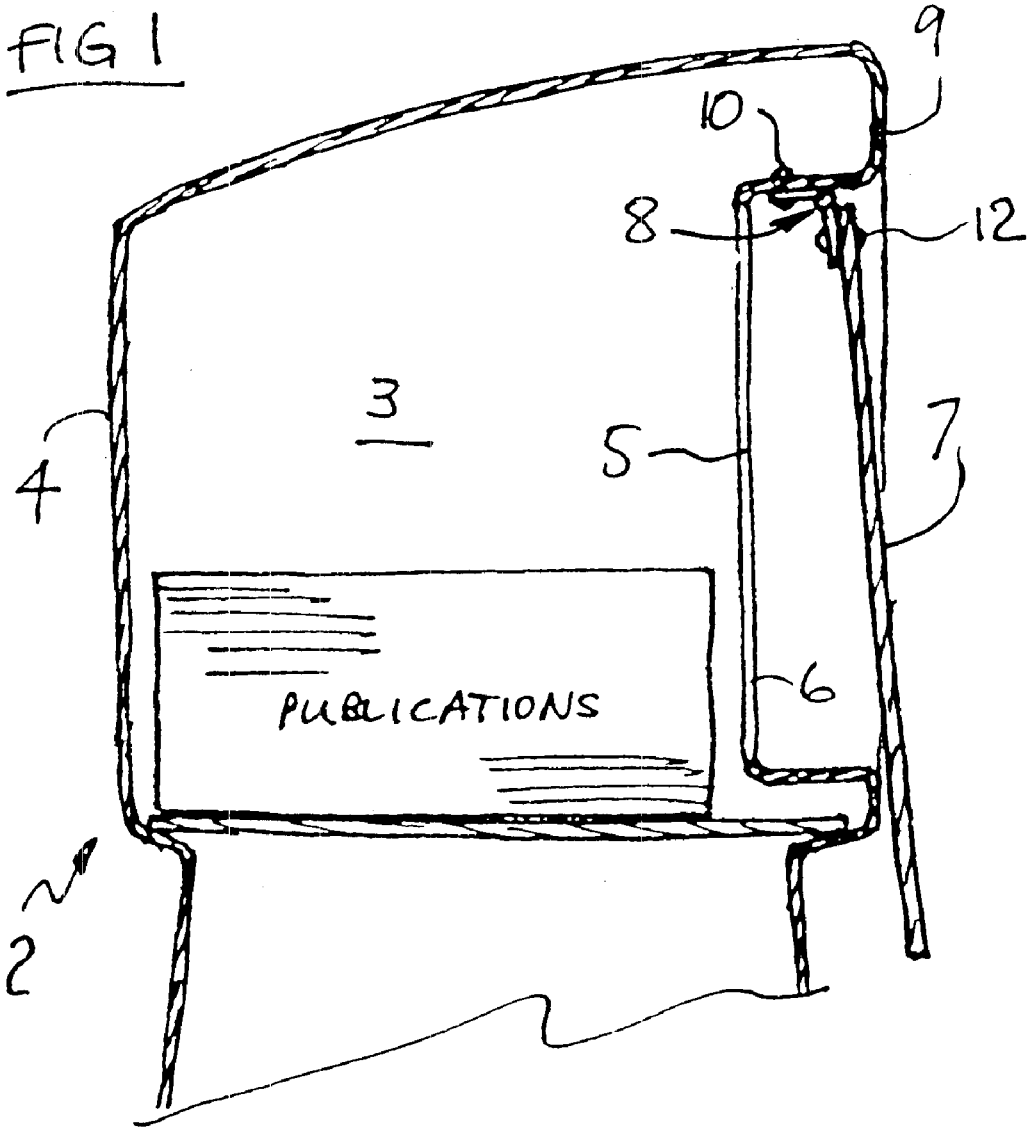
FIG. 1 is a side-view, in cross-section, of a prior-art news-stand.

The prior-art news-stand 2 of FIG. 1 includes a compartment 3 for storing a stack of publications such as advertising handouts. A body-shell 4 of the news-stand is rotation-moulded. A panel of the as-moulded body-shell is cut out, leaving an aperture 5. The cut-out panel serves as a tray 6 on which the publications rest.

The aperture 5 is closed by a pivoting door 7. The door is made from transparent polycarbonate plastic. The door 7 is mounted to the body-shell 4 by means of a (metal) piano-hinge 8. The piano-hinge is secured to the undersurface of a roof-fold 9 of the body-shell 4 by means of rivets 10 (typically, four or five rivets) and is secured to the door 7 by means of rivets 12. The cost of providing the piano-hinge 8, and the labour cost of securing the piano-hinge to the body and door, if the job is done properly, can be quite high. Furthermore, the performance of the piano-hinge can be poor, in terms of the resistance of the news-stand 2 to the kind of abuse meted out to articles located in places that are accessible to the public, and in terms of resistance to the weather.

The news-stand 2 of FIG. 1 is approximately one metre high, and has a plan area of 35×40 cm. The body-shell 4 of the news-stand 2 is rotation-moulded in LLDPE plastic. In the rotation-moulding of such large articles, a charge of hot liquid plastic is placed inside a (large) mould, and the mould is rotated continuously about several axes, whereby the liquid plastic forms a uniform coating on the inside of the mould. The melt solidifies, and the final form of the product, when removed from the mould, is a completely-enclosed hollow shell, having the form of the mould. In a product like a one-metre-high news-stand, the skin of the shell would have a thickness of about four millimetres.

Figure 4:
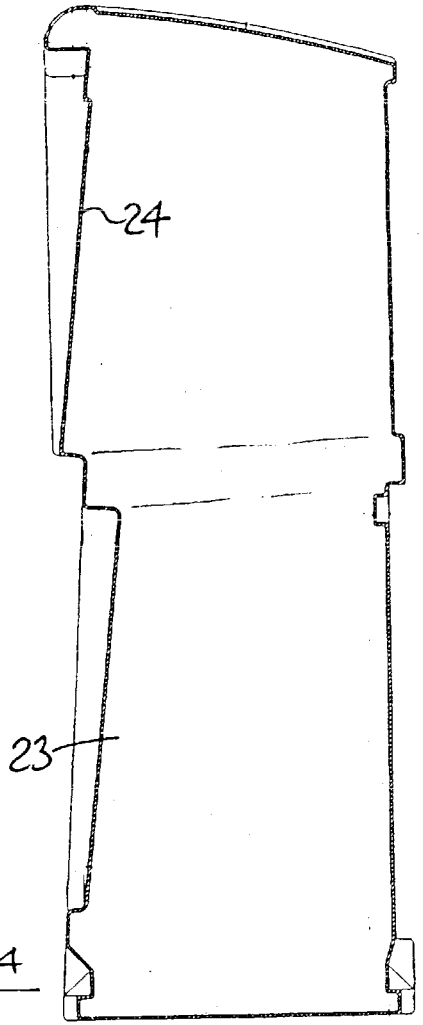
FIG. 4 is a cross-section taken on line 4—4 of FIG. 3.

FIG. 2 shows a news-stand 20 that embodies the invention. FIGS. 3 and 4 show a rotation-moulded body-shell 23, as used in the news-stand 20, as a completely-enclosed hollow shell structure, which is the condition of the body as it is taken from the mould. To manufacture the body as a component of the news-stand 20, a front panel 24 of the body is cut out, leaving an aperture 25, the cut edge of which is shown at 25*a* (FIG. 5). As shown, the surface 26 from which the panel 24 is cut is recessed back from the front face 27 of the body.

Once separated, the cut panel 24 is placed through the aperture 25, and laid flat on ridges 28 moulded in the body 23 (FIG. 5). Thus, the cut-out panel 24 is not wasted but serves as a floor of compartment 29.

FIG. 6 shows a hinged door 30 assembled into the body-shell 23 of the news-stand 20. The door 30 of the news-stand is made from a sheet of transparent polycarbonate plastic. As shown in FIGS. 7 and 8, the sheet is flat, except that the left and right edges are bent to form upright flanges 32. Polycarbonate sheet can be bent in this manner in a brake-press, and in a cold condition, i.e without heat-treatment. Holes 34 are formed in the flanged edges 32, near the top, as shown.

FIG. 2 shows the body 23 moulded with an overhanging lintel 35. The overhanging lintel extends almost the whole width of the recessed aperture 25, except at the left and right ends of the lintel. The ends of the lintel are so moulded as to form left 1 and right pockets 36. The overhanging lintel 35 is a preferred feature, but is not essential, and FIGS. 9 and 10 are close-ups of a moulded body in which there is no overhanging lintel.

As shown in FIGS. 9 and 10, the aperture 25 is bounded by a roof-fold 37 of the body 23, and by left and right side-folds, the right-side-fold 38 being visible in FIG. 9. A hinge-pin-hole 39 is formed through both the inner-wall 40 and the outer-wall 42 of the right side-fold 38. A long hinge-pin 43, of ten-millimetre diameter nylon rod, passes right through the hinge-pin-holes 39 in the inner and outer walls 40,42 of both the left and right side-folds 38.

The holes 34 in the flanged edges 32 of the door 30 correspond to the hinge-pin 43, and the door 30 pivots on the hinge-pin in the manner as shown. The holes 34 in the door are sized to provide a good clearance, for an easy swinging or pivoting movement of the door about the hinge-pin, whereas the holes 39 in the side-folds are sized to provide a tightly-gripping fit on the hinge-pin.

FIG. 11 shows a modification in which the two holes in the inner and outer walls 40,42 of the right side-fold are supplemented by a reinforcing cross-tube 45. This cross-tube 45 is moulded into the body-shell 23 of the news-stand. FIG. 12 shows a portion of the mould in which the body is made, illustrating a former 46 around which the skin of plastic forms during rotation-moulding.

As will be understood from FIG. 10, the interior compartment 29 of the news-stand is (when the door 30 is closed) quite well protected from the weather, and even from rain driving right at the door. However, a problem with the FIGS. 9,10 embodiment is that much of the length of the hinge-pin 43 lies exposed. A destruction-minded individual would be able to grasp the hinge-pin in the hand, and perhaps break or damage the hinge-pin.

By contrast, the overhanging lintel 35 of the FIG. 2 embodiment enshrouds the hinge-pin 43, rendering it more or less invisible and un-reachable. The overhanging lintel also provides extra protection from the weather.

Also, in FIG. 2, the pockets 36 created by the left and right end-walls 47 of the lintel 35 mean that there is a third wall thickness of the rotation-moulded body-shell through which the hinge-pin 43 passes. FIGS. 13–18 show how the rotation-moulded body-shell 23 is shaped, and how the hinge-pin is secured, and how the door is pivotable upon the hinge-pin.

As will be understood from FIG. 13, the long hinge-pin 43 is supported in the body at a total of six locations, i.e the outer-wall 42 and the inner-wall 40 of the right-side-fold 38, together with the right-end-wall 47 of the lintel 35; and the same thing at the left side of the news-stand. The resulting structure supports the hinge-pin in a very rigid and secure manner, well able to resist the kind of abuse likely to be imposed on a hinged door in a public place. Of course, that is not to say that the hinge structure is completely unbreakable.

The left and right side-folds 38 surrounding the aperture 25 comprise rigid structures in themselves, whereby the news-stand is stiff and rigid, even though the panel 24 has been removed to form the aperture. Thus, the left and right side-folds 38 not only provide rigid support for the hinge-pin, but also provide strong, rigid columns that prevent the body structure from distorting. The roof-fold 37 also adds to the rigidity of the body structure. Of course, again, this is not to say that the news-stand is completely rigid; however, it is recognized that the as-described structure of the door, and of the body of the news-stand, and of the hinge-pin, are very much in keeping with and compatible with each other, and the combination is highly suitable for use in a publicly-accessible outdoor structure.

For assembly of the door into the body, the hinge-pin holes in the door are simply aligned with those in the body-shell, and the nylon rod 43 is pushed through. The rod is tight in the (six) hinge-pin holes in the body. The as-installed nylon rod is longer than the distance between the left and right outer-walls 42, and the excess length may be trimmed off after the rod is installed. After installation, the nylon material in fact is gripped strongly to the plastic body, whereby generally no glue is required to keep the rod in place, although glue may be used if preferred. Assembly is a simple, quick, production-line procedure, which compares very favourably with the finicky, labour-intensive procedure associated with metal hinges held in place with screws or rivets.

As described, the hinge-pin 43 is orientated horizontally, and at the top of the door, whereby the door hangs from the hinge-pin, and no springs etc. are needed to keep the door closed (although springs may be provided if preferred). Alternatively, the hinge-pin may be orientated vertically, i.e the hinge-pin is set at the right or left edge of the door. Alternatively again, the hinge-pin may be horizontal, but at the bottom of the door. In these cases, the use of a spring to close the door is more important.

As described, the hinge-pin extends as a single nylon rod, right across the whole width of the news-stand. Alternatively, the hinge-pin may be in left and right hinge-pin-portions. The important aspect in the context of the invention is that each (i.e left and right) element or portion of the hinge pin should engage at least two hinge-pin holes in respective walls of the rotation-moulded body-shell, and preferably three. Preferably, the left flange of the door should be positioned between two walls of the body-shell, and the right flange should be positioned between two walls of the body-shell.

What is claimed is:

1. A news-stand, which includes a compartment suitable for the storage therein of a stack of publications;

the news-stand includes a body, and the body is formed from a rotation-moulded shell of plastic;

the body includes an aperture, and the aperture is so shaped and positioned in the news-stand as to be capable of providing access for the removal, through the aperture, of publications from within the compartment;

the news-stand includes a door, and a hinge-pin, and the door is pivotable about the axis of the hinge-pin;

the arrangement of the news-stand is such that the door is pivotable about the hinge-pin between a closed position in which the door closes off the aperture, and an open position in which a person can reach into the compartment, and can remove a publication therefrom through the aperture;

the rotation-moulded shell is so configured as to form, as a first wall of the aperture, a first-fold of the rotation-moulded shell, and, as an opposite wall of the aperture, an opposite-fold of the rotation-moulded shell;

the first-fold includes a first-fold-inner-wall, and a first-fold-outer-wall which is spaced from the first-fold-inner-wall;

the opposite-fold includes an opposite-fold-inner-wall, and an opposite-fold-outer-wall which is spaced from the opposite-fold-inner-wall;

the first-fold-inner-wall, the first-fold-outer-wall, the opposite-fold-inner-wall, and the opposite-fold-outer-wall, are formed with respective fold-hinge-pin-holes therein;

a first element of the hinge-pin extends through the fold-hinge-pin-holes in the first-fold -inner-wall and the first-fold-outer-wall and straddles the space between the first-fold-inner-wall and the first-fold-outer-wall;

an opposite element of the hinge-pin extends through the fold-hinge-pin-holes in the opposite-fold-inner-wall and the opposite-fold-outer-wall and straddles the space between the opposite-fold-inner-wall and the opposite-fold-outer-wall;

the door includes a first-flange and an opposite-flange, having respective door-hinge-pin-holes therein;

the first element of the hinge-pin extends through the door-hinge-pin-hole in the first-flange;

and the opposite element of the hinge-pin extends through the door-hinge-pin-hole in the opposite-flange.

2. Apparatus of claim 1, wherein the hinge-pin comprises a unitary long rod of plastic, and the first and opposite elements of the hinge pin comprise respective portions of the long rod.

3. A news-stand, which includes a compartment suitable for the storage therein of a stack of publications;

the news-stand includes a body, and the body is formed from a rotation-moulded shell of plastic;

the body includes an aperture, and the aperture is so shaped and positioned in the news-stand as to be capable of providing access for the removal, through the aperture, of publications from within the compartment;

the news-stand includes a door, and a hinge-pin, and the door is pivotable about the hinge-pin;

the arrangement of the news-stand is such that the door is pivotable about the hinge-pin between a closed position in which the door closes off the aperture, and an open position in which a person can reach into the compartment, and can remove a publication therefrom through the aperture;

the rotation-moulded shell is so configured as to form, to the left of the aperture, a left-side-fold of the rotation-moulded shell, and, to the right of the aperture, a right-side-fold of the rotation-moulded shell;

the left-side-fold includes a left-inner-wall, and a left-outer-wall which is spaced from the left-inner-wall in the left-right sense;

the right-side-fold includes a right-inner-wall, and a right-outer-wall which is spaced from the right-inner-wall in the left-right sense;

the left-inner-wall, the left-outer-wall, the right-inner-wall, and the right-outer-wall, are formed with respective wall-hinge-pin-holes therein;

the hinge-pin extends through the wall-hinge-pin-holes, and across the space between the left-inner-wall and the left-outer-wall, and across the space between the right-inner-wall and the right-outer-wall;

the door includes a left-side-flange and a right-side-flange, having respective door-hinge-pin-holes therein, and the hinge-pin extends through the door-hinge-pin-holes.

4. Apparatus of claim 3, wherein the hinge-pin comprises a unitary long rod of plastic, which extends through all four of the said hinge-pin-holes.

5. Apparatus of claim 3, wherein:

the body is formed with a lintel, which lies above the aperture, and extends between the left and right side-folds of the rotation-moulded shell;

the left-inner-wall of the left-fold is spaced from the right-inner-wall of the right-fold a distance D;

the width of the lintel is defined as the overall distance between a left end-wall of the lintel and a right-end-wall of the lintel;

the width of the lintel is shorter than the distance D, whereby a left-pocket is created between the left-inner-wall of the left-fold and the left-end-wall of the lintel, and whereby a right-pocket is created between the right-inner-wall of the right-fold and the right-end-wall of the lintel;

the left-side-flange of the door is located in the left-pocket, and the right-side-flange of the door is located in the right-pocket;

the left and right end-walls of the lintel are formed with respective lintel-hinge-pin-holes;

the hinge-pin extends also through the lintel-hinge-pin-holes.

6. Apparatus of claim 5, wherein the hinge-pin comprises a unitary long rod of plastic, which extends through all six of the said hinge-pin-holes.

7. Apparatus of claim 5, wherein:

the door is comprised of a generally flat plate, and the flanges protrude forwards from the flat plate;

and a top edge of the flat plate lies, when the door is closed, behind the lintel.

8. Apparatus of claim 5, wherein the space between the left-inner-wall and the left-outer-wall is between 1 cm and 3 cms, and the space between the right-inner-wall and the right-outer-wall is between 1 cm and 3 cms.

9. Apparatus of claim 5, wherein the width of the left pocket is between 1 cm and 3 cms, and the width of the right-pocket is between 1 cm and 3 cms.

10. Apparatus of claim 3, wherein the hinge-pin comprises a single plastic rod, which extends right across the rotation-moulded shell.

11. Apparatus of claim 5, wherein:

the hinge-pin comprises a single plastic rod, which extends right across the rotation-moulded shell;

the lintel overhangs the aperture, and the arrangement of the body is such that the hinge pin lies, for most of its length, concealed behind the lintel.

12. As in claim 3, wherein the aperture was formed by cutting out a panel from the rotation-moulded shell.

13. Apparatus of claim 3, wherein the aperture is bounded to the left by the left-side-fold and to the right by the right-side-fold.

* * * * *